United States Patent [19]

Harper, Jr.

[11] 4,053,063

[45] Oct. 11, 1977

[54] APPARATUS FOR HANDLING PIPE AT WELL SITE

[75] Inventor: Roland George Harper, Jr., Lafayette, La.

[73] Assignee: Weatherford/Lamb, Inc., Houston, Tex.

[21] Appl. No.: 677,956

[22] Filed: Apr. 19, 1976

[51] Int. Cl.[2] ..... E21B 19/00

[52] U.S. Cl. ..... 214/2.5; 175/85; 212/73; 214/1 P; 104/112

[58] Field of Search ..... 214/2.5, 1 P; 104/112–117; 212/72–121; 175/52, 85

[56] References Cited

U.S. PATENT DOCUMENTS

| | | | |
|---|---|---|---|
| 1,053,305 | 2/1913 | Leue | 212/72 |
| 1,693,208 | 11/1928 | Nelson | 212/98 |
| 3,076,562 | 2/1963 | Pitts | 214/2.5 X |
| 3,268,095 | 8/1966 | Durbin | 214/2.5 |
| 3,675,794 | 7/1972 | Ingram et al. | 104/114 X |
| 3,713,547 | 1/1973 | Beck | 214/2.5 |
| 3,825,129 | 7/1974 | Beck | 212/72 X |

*Primary Examiner*—Frank E. Werner
*Attorney, Agent, or Firm*—Fulbright & Jaworski

[57] ABSTRACT

A pipe handling apparatus for transporting pipe, drill collars, or similar elongate members between the elevated drilling floor of a well derrick and a lower storage area is disclosed. The apparatus comprises a pair of support cables forming a cable track extending between the rig floor and the storage area with a rear bucket that receives and holds the lower end of the pipe riding on the support cables. The rear bucket is movable along the cable track by a third cable which controls the transporting of the pipe from the rig to the storage area in a pipe lay-down operation. A series of support buckets is anchored proximate the rig floor and is extendable along the cable track as the pipe is being transported, providing support to the intermediate portion of the pipe. A draw works, typically in the vicinity of the storage area, secures one end of the cable track and is provided with a take-up mechanism for the support cables to enable them to be slackened to permit the pipe to be laid down for unloading from the rear bucket and the chain of buckets in the storage area. The take-up mechanism also enables the cable track to be tensioned to facilitate the transportation of a pipe to the elevated rig floor and includes a mechanism for equalizing the tension in the support cables.

5 Claims, 12 Drawing Figures

APPARATUS FOR HANDLING PIPE AT WELL SITE

BACKGROUND OF THE INVENTION

The instant invention relates to an apparatus for handling elongate members, e.g., drill pipe, drill collars, well tubing, etc., at a well drilling site. More particularly, this invention provides a cable transport mechanism which may be used either to deliver pipe to the elevated rig floor well derrick or to lay down pipe from the rig floor to a lower storage area. Hence, the apparatus herein may be employed throughout the drilling operation for pipe handling tasks, but will be especially useful in pipe lay down operations.

At the well site where an oil well is being drilled or reworked, it is necessary that provision be made for handling of the drill pipe, well tubing, well casing, or drill collars which are used in the well. For example, during the drilling operation, it is continually necessary to provide additional lengths of drill pipe or the like to the derrick as the drilling progresses. Similarly, when the drilling operation is concluded or when problems are encountered during drilling, it may be necessary or desirable to remove the drilling string from the borehole. Accordingly, the operators at the well site are constantly confronted with the problem of efficiently handling the various tubular members used during the drilling operation, and of transporting these tubular members between the rig floor and a nearby storage area where the collars and drill pipe are typically maintained on racks in a stand-by position.

It has been customary in handling pipe or other tubular goods at a well site to provide an inclined trough or skidway adjacent the open side of the derrick to facilitate the transfer of the pipe from the drilling rig substructure, called the rig floor, and the pipe rack storage area. However, due to the weight of these tubular members, such relatively uncontrolled handling can result in damage to thread connections, and also because of the inordinate amount of manual handling which is required, can result in injury to workers at the well site.

Considerable attention has been directed toward devising various types of drill pipe handling apparatus in order to facilitate transfer of tubular goods from the pipe storage area to the usually elevated rig floor of the derrick substructure, and subsequently to transfer the same back to the storage area. One approach has been to provide a mechanical device with a pipe holding through which will accept a length of pipe from the storage area and thereafter lift the pipe or incline it in order to "feed" the pipe upwardly toward the rig floor. Illustrative of such devices is U.S. Pat. No. 3,559,821. Alternatively, powered trolleys riding on tracks could be provided to transport the pipe from the rig floor to the storage area or vice versa, as shown in U.S. Pat. No. 3,268,095 and the like.

Another approach has been to use a cable transport system to handle the pipe. A cable system has inherent advantages in that it can be most easily adapted to the conditions at the well site. Unlike purely mechanical systems, cable systems can usually be adapted to deliver pipe from a convenient storage area, which may be in a different position at different well sites to the rig floor, which may vary in elevation depending upon the particular well being drilled. U.S. Pat. Nos. 3,532,229 and 3,368,699 disclose cable systems for handling pipe at a well site. But in these patents, the pipe is secured only at one end to the cable system, and hence, manual attention of the workers is required to prevent damage to the free end of the pipe. Moreover, the systems disclosed in these patents rely to significant extent upon the use of the traditional pipe skidway.

Another approach has been to use transport carriages supported on a cable to handle the pipe. The use of front and rear carriages to support the pipe at the ends remedies the problems associated with a free and unsupported lower end as found in the above-described prior cable systems, but a system of this type does not permit rapid pickup or laydown operation. Also, if a change is made in the size of pipe to be handled, the carriages must be changed to accommodate the new pipe. An example of this approach to pipe handling at a well site is the apparatus disclosed in U.S. Pat. No. 3,825,129.

SUMMARY OF THE INVENTION

In accordance with the present invention, an apparatus for transporting an elongate member such as a section of drill pipe or the like between an elevated area, for example, a rig floor, and a lower storage area is provided which substantially enhances the speed of pipe handling and reduces the possibility of dropping the pipe.

The present invention comprises a cable track having a pair of support cables extending between the elevated rig floor and the lower storage area. A rear bucket is disposed on and movable along the cable track by a control mechanism such as a cable and sheaves arrangement. The rear bucket receives and holds the lower end of a section of drill pipe to provide support and includes a gripping mechanism mounted on the bucket to engage the end of the pipe preventing it from falling out while being transported.

A series of buckets comprising individual support buckets connected one to another by a length of cable or the like is positioned on the support cable track. The support buckets are movable along the cable track with the entire chain being anchored at a point proximate the rig floor. The series of buckets is situated above the rear bucket on the cable track; and when the rear bucket is raised to its uppermost position, the support buckets are pushed together. After the lower end of the pipe section to be transported is placed into the rear bucket and the bucket is begun to be lowered through the action of the control mechanism, the series of support buckets begins to move downwardly. As the rear bucket is being lowered, the series of support buckets extends out along the cable track. When the connection cables between the support buckets are stretched out, downward travel of the support buckets along the cable track is stopped. As the rear bucket is further lowered along the cable track, the lower end of the pipe section is inherently moved radially outward from the well derrick resulting in the pipe section becoming increasingly reclined. After the rear bucket has moved a sufficient distance down the cable track and out from the derrick, the pipe section being transported will recline far enough to be supported along the portion intermediate its ends by the series chain of support buckets which may at this point be fully extended. Each support bucket comprises a roller upon which the pipe section rests while being supported by the bucket; and as the pipe section continues to be transported by lowering of the rear bucket, the pipe section moves along over the rollers. A stop mechanism on the cable track limits the downward travel of the rear bucket along the cable track and consequently stops the travel of the pipe section being transported.

A draw works assembly is provided that receives the lower end of the cable track and equalizes the tension in each of the support cables forming the cable track. The draw works assembly includes a frame suitable for mounting on a skid with first and second fixed sleeves added on the frame. First and second movable sheaves are aligned with first and second fixed sheaves for receiving support cables that alternately pass over the fixed and the movable sheaves. First and second drums for taking in or paying out cable are provided, and a power drive mechanism for moving the first and second movable sheaves with respect to the fixed sheaves to slacken or tension the support cables is included. The first and second movable sheaves are disposed on opposite sides of a pivot point through which the power drive mechanism acts in moving the movable sheaves, to thereby equalize the tension in the support cables.

The draw works assembly slackens the support cables to being laying down the pipe section supported in the rear bucket and the lower support bucket of the chain of support buckets. As the cables are slackened, the pipe section is reclined further until it is laid down at the storage area. The pipe section can then be removed from the buckets and the cables tensioned in preparation of raising the rear bucket along the cable track to receive another section of pipe. With the chain of support buckets removed, the apparatus can be utilized for pipe section pickup operations also.

Other aspects of the invention include a bucket for receiving a first end of the elongate member to be transported, which bucket comprises a frame having support sheaves mounted thereon to movably support the frame on a cable track. In addition, the bucket includes a gripping mechanism for engaging the elongate member to limit movement of the frame relative to the elongate member.

BRIEF DESCRIPTION OF THE DRAWINGS

The instant invention will be more particularly understood with reference to those particular embodiments of the invention as illustrated in the accompanying drawings.

DESCRIPTION OF THE PREFERRED EMBODIMENT

Figure 1:
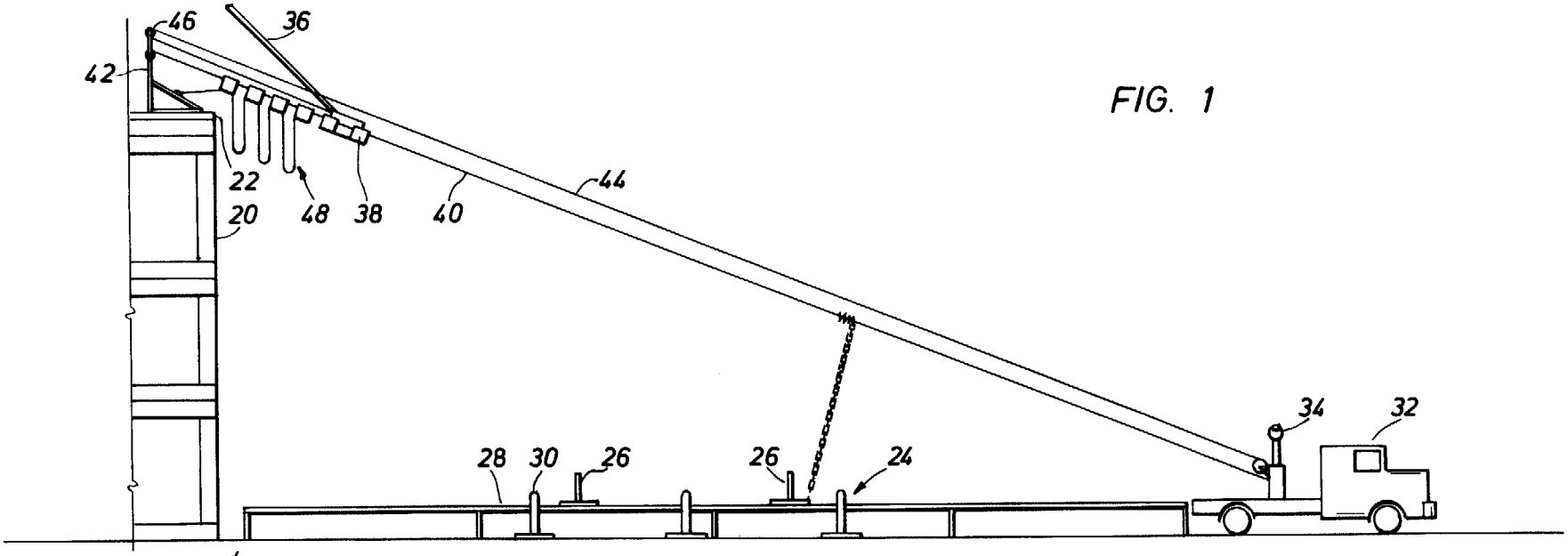
FIGS. 1 - 5 are elevation views of a pipe handling apparatus in accordance with the present invention in place at the well site, illustrating the sequence of operation of the pipe handling apparatus during a pipe lay-down operation.

Referring now to FIGS. 1 - 5, apparatus in accordance with the present invention is shown operationally disposed proximate well drilling derrick 20 which is of a conventional construction and used in drilling operations. Derrick 20 has a rig floor 22 on which there is positioned a standard rotary table (not shown) from which the drilling string is suspended in a conventional manner. The upper portion of the derrick is not shown but includes an upper platform from which there is supported a traveling block having an elevator suspended therefrom. The elevator is a standard oil field tool for the handling of pipe within a derrick and is used to pick up pipe when going into the well, and to deliver pipe for transport to storage by the apparatus of this invention when coming out of the well borehole.

The pipe handling apparatus of this invention is disposed to one side of the derrick and transports pipe and other elongate members between the rig floor 22 and a lower storage area generally denoted by a reference numeral 24. In the storage area 24, a skid assembly 26 is provided atop catwalk 28. The height of skid assembly 26 may be selectively varied in order to facilitate the transfer of pipe between pipe storage rack 30 and the pipe handling section of the skid assembly.

A truck 32, having draw works assembly 34 mounted on the rear thereof, is disposed proximate catwalk 28. Draw works assembly 34 is a hydraulically powered unit for operating the pipe handling apparatus and at the conclusion of the pipe handling operation at one side rendering the entire apparatus readily transportable to another drilling site as needed.

Referring now specifically to FIG. 1, the apparatus of the present invention is shown at the beginning of a pipe lay-down operation. A section of drill pipe 36 is supported from above by the elevator (not shown) with the lower end being supported and held in rear bucket 38. Side-by-side support cables 40 are fixed at their upper end to support stand 42, which is mounted to rig floor 22, and the lower ends of support cables 40 are attached to draw works assembly 34. Support cables 40 form a cable track extending with an inclined attitude between the elevated area of the rig floor and the lower storage area. The cable truck, therefore, extends downwardly and outwardly from the derrick 20.

Pull cable 44 connects to rear bucket 38, and after passing through sheave 46 on support stand 42, connects at its other end to draw works assembly 34. Rear bucket 38 is movable along the cable track formed by support cables 40 with pull cable 44 being utilized to apply a force to raise bucket 38 or controllably released to lower rear bucket 38. During the loading of the section of pipe 36 into rear bucket 38, pull cable 44 holds rear bucket 38 in a fixed position along the cable track. Pull cable 44, therefore, serves as a control mechanism for rear bucket 38.

Also mounted on support cables 40 is a series of support buckets generally denoted by reference numeral 48. The series of support buckets comprises preferably four support buckets, each individually movable along the cable track formed by support cables 40. The series of support buckets 48 are disposed ahead of rear bucket 38 with the uppermost support bucket in the series being anchored to support stand 42 by a length of cable, rope, or other similar flexible connecting material.

Figure 2:
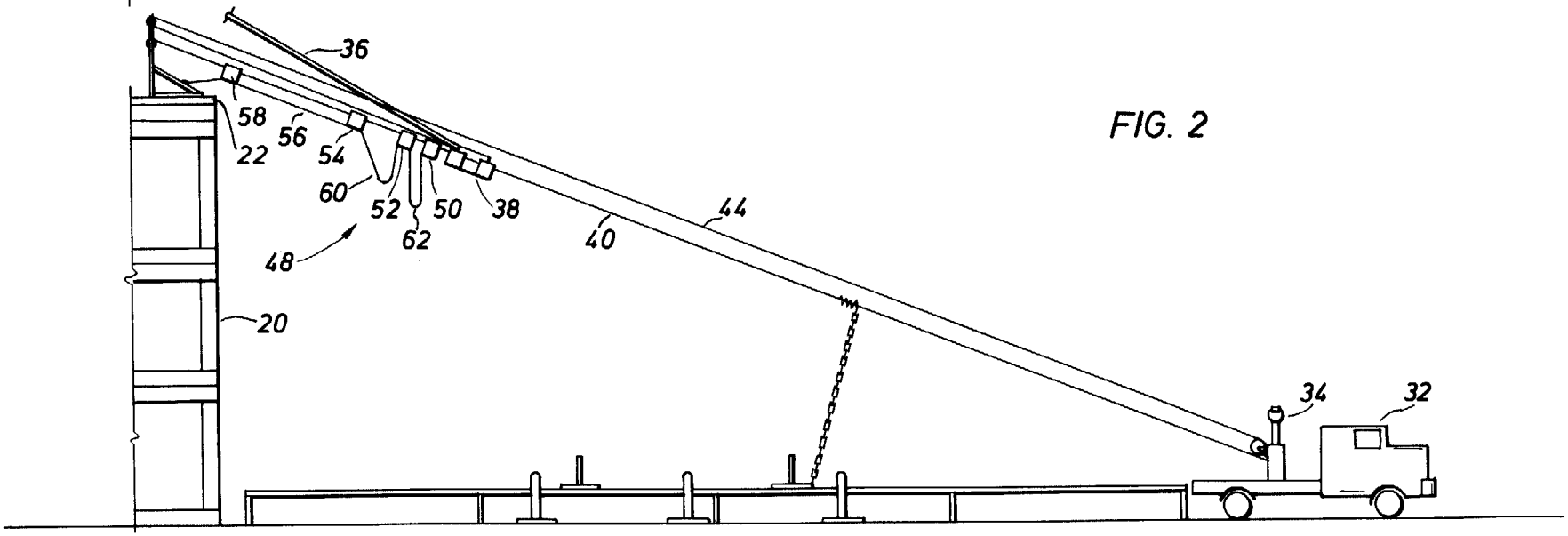

Referring next to FIG. 2, the section of pipe 36 remains supported at its upper end by the elevator and at its lower end by rear bucket 38. In this view, rear bucket 38 has been lowered along the cable track formed by support cables 40 to place the section of pipe 36 in a more reclining position. To so permit the lowering of rear bucket 38, pull cable 44 is let out from draw works 34. By the lowering of rear bucket 38, the series of buckets 48 is allowed to extend out along the support cables 40. Specifically, movement of rear bucket 38 to a lower position permits support buckets 50, 52 and 54 to also move to a lower position along the cable track. In FIG. 2, rear bucket 38 has been lowered a sufficient distance to fully extend the connecting cable 56 which attaches between support bucket 54 and support bucket 58. In the position shown, connecting cable 60 is only partly stretched out and connecting cable 62 is not stretched at all.

Figure 3:
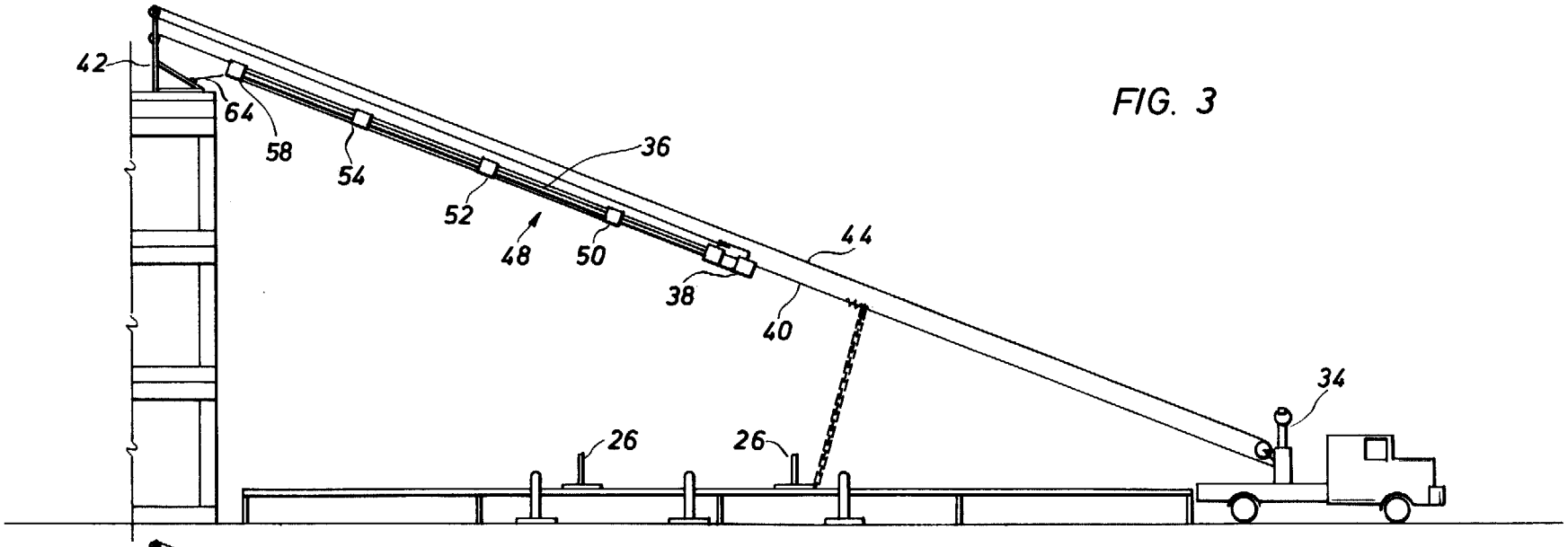

Turning now to FIG. 3, rear bucket 38 is shown in a yet lower position along support cables 40, as pull cable 44 has been let out further from the draw works 34. With rear bucket 38 being further lowered to this position, the series of support buckets 48 is fully extended along the guide track formed by support cables 40. The support buckets 50, 52, 54 and 58 are preferably spaced at regular intervals and maintained in their position by the anchor cable 64 attached between support bucket 58 and support stand 42.

It will be observed that the section of pipe 36 has been released from the elevator and is supported along its length by the support buckets forming the series of buckets 48 and by rear bucket 38. Rear bucket 38 includes a stop plate (see FIG. 10) which prevents the pipe 36 from sliding out of the buckets.

Figure 4:
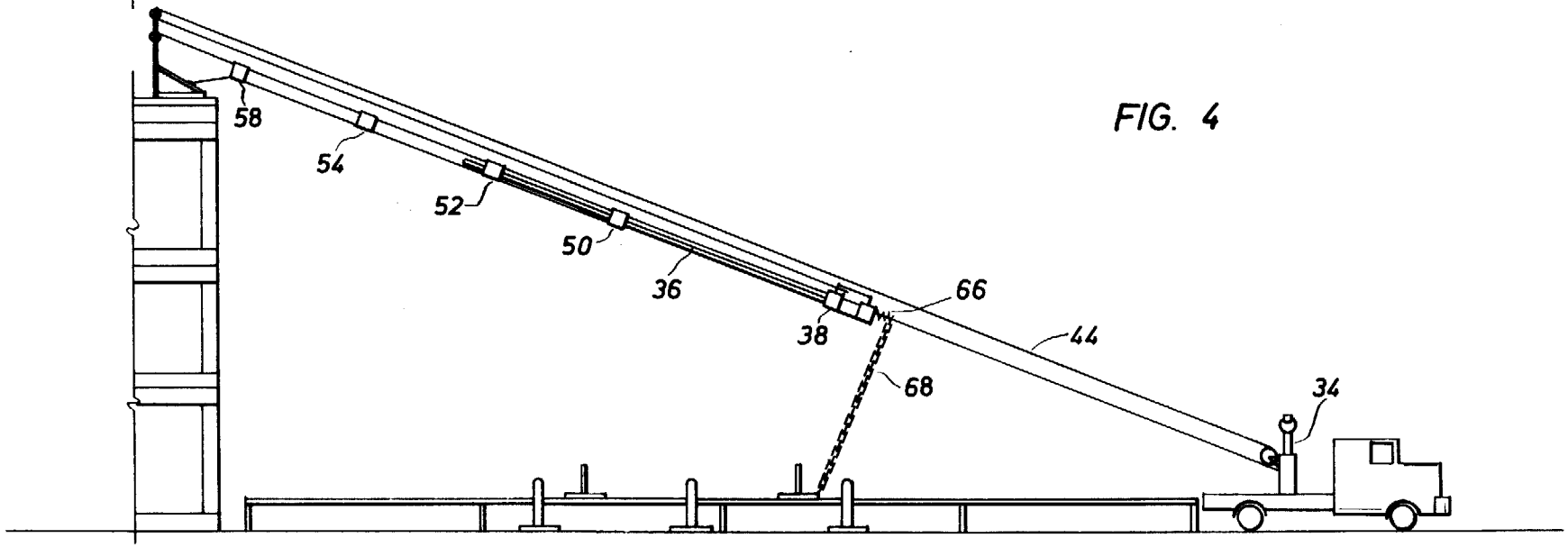
Figure 5:
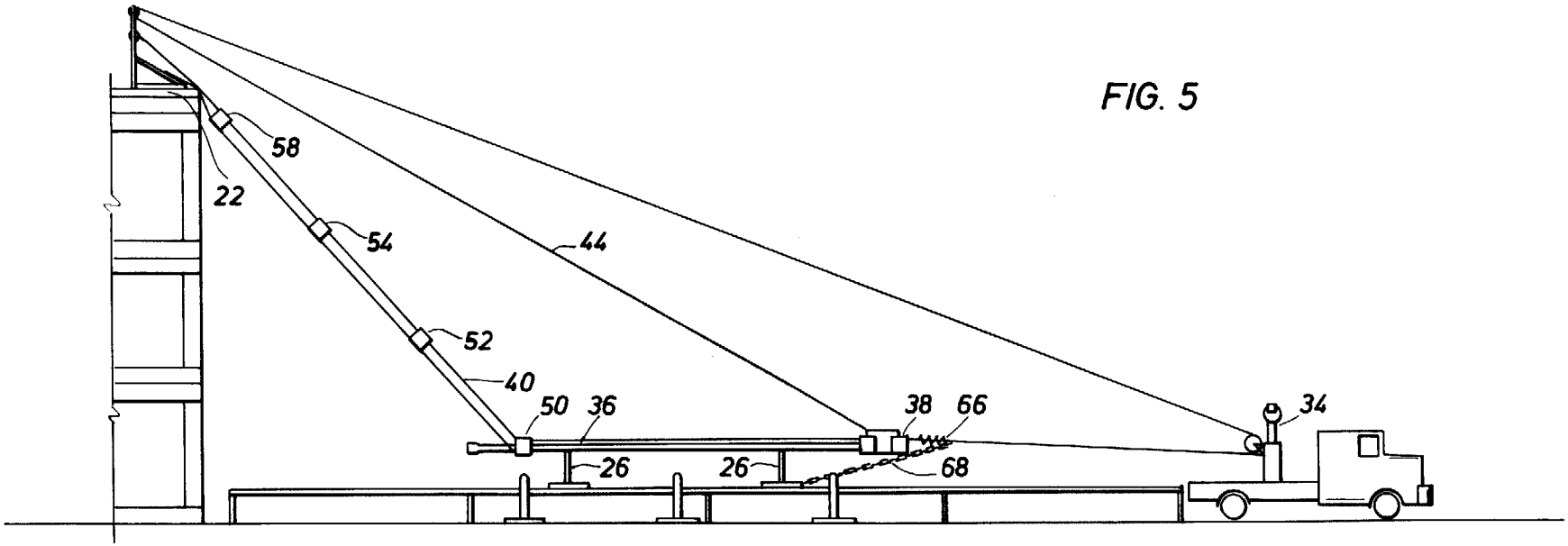
Figure 7:
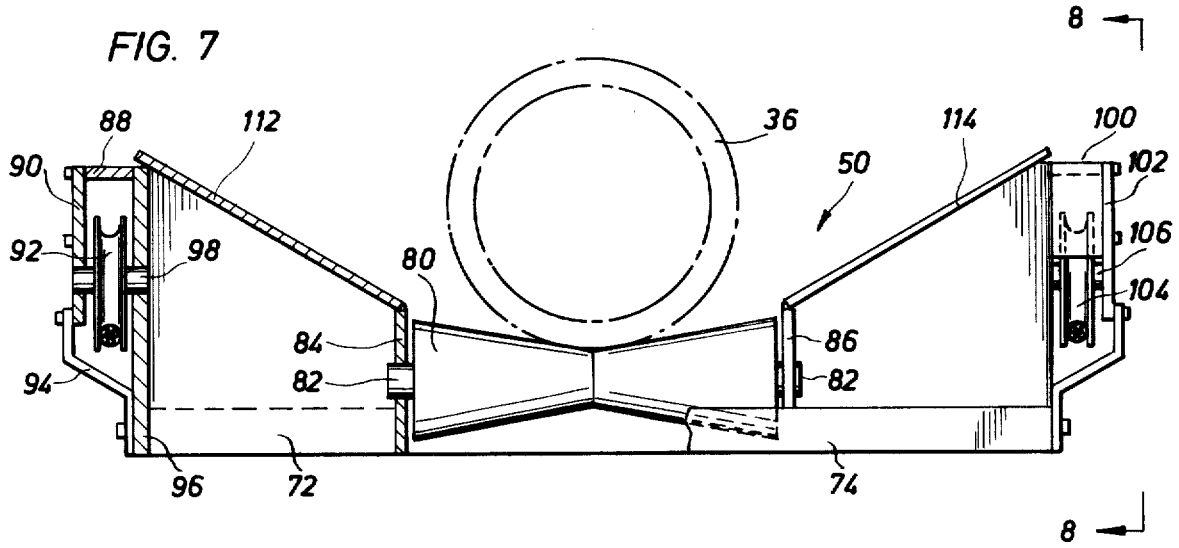

Transportation of pipe 36 continues, as shown in FIG. 4, with rear bucket 38 continuing to be lowered by pull cable 44. In so lowering rear bucket 38, pipe 36 moves along on the support buckets 50, 52, 54 and 58 which maintain their position along support cables 40. Pipe 36 continues to be supported by the support buckets and rear bucket 38 as it is being transported to the storage area. The support buckets are provided with rollers, as illustrated in FIG. 7, to permit pipe 36 to move easily thereover without hangup.

The lowering of pipe 36 continues with rear bucket 38 being permitted to move further down the guide track as controlled by cable 44 until it comes into contact with stopping mechanism 66. As shown, stopping mechanism 66 is carried on support cables 40 and has a chain 68 which attaches to skid 26. Stopping mechanism 66 along with chain 68 limits the downward travel of rear bucket 38.

From FIG. 4, it may be seen that pipe 36 is lowered sufficiently, before rear bucket 38 contacts stopping mechanism 66, to be free from support buckets 54 and 58. As shown, pipe 36 is supported at this point by rear bucket 38, support bucket 50 and support bucket 52. However, pipe 36 is very close to sliding off support bucket 52.

Upon rear bucket 38 and pipe 36 reaching the position shown in FIG. 4, draw works 34 slackens support cables 40 and lets out an additional length of cable 44, permitting rear bucket 38 and pipe 36 to move slightly further back, being restrained by stop mechanism 66 and chain 68. In moving pipe 36 slides from support bucket 52, but remains supported by support bucket 50 disposed at the front end of the pipe. Support cables 40 continue to be slackened by draw works 34 with pipe 36 becoming more inclined until it is finally laid down on skids 26. Support cables 40 are slackened an additional amount to permit removal of the stand of pipe 36 from skids 26 and be placed into storage.

After the stand of pipe 36 has been moved to storage, support cables 40 are drawn in by draw works 34 to again tension them and reestablish the cable track. Cable 44 can be drawn back in causing rear bucket 38 to advance upwardly on the cable track, moving rear bucket 38 toward the rig floor 22. As it is moved upwardly, rear bucket 38 engages the support buckets 50, 52, 54 and 58 along the way, causing them to be pushed together. Rear bucket 38 is moved along support cables 40 until reaching the location shown in FIG. 1, at which time a new section of pipe is placed in the rear bucket and a new pipe lay-down operation is again ready to begin.

In the case of pipe pickup, the series of support buckets 48 is removed and replaced with a single support bucket. The pipe is supported at one end by the rear bucket 38 and at the other end by the single support bucket. Pipe pickup is begun by tensioning the support cables until they assume a taut attitude. The section of pipe is then transported upwardly by the front and rear buckets as a pull cable attached to the rear bucket is drawn in by a draw works assembly. Upon reaching the rig floor, the anterior end of the pipe is gripped in an elevator and the pipe section is raised.

Figure 6:
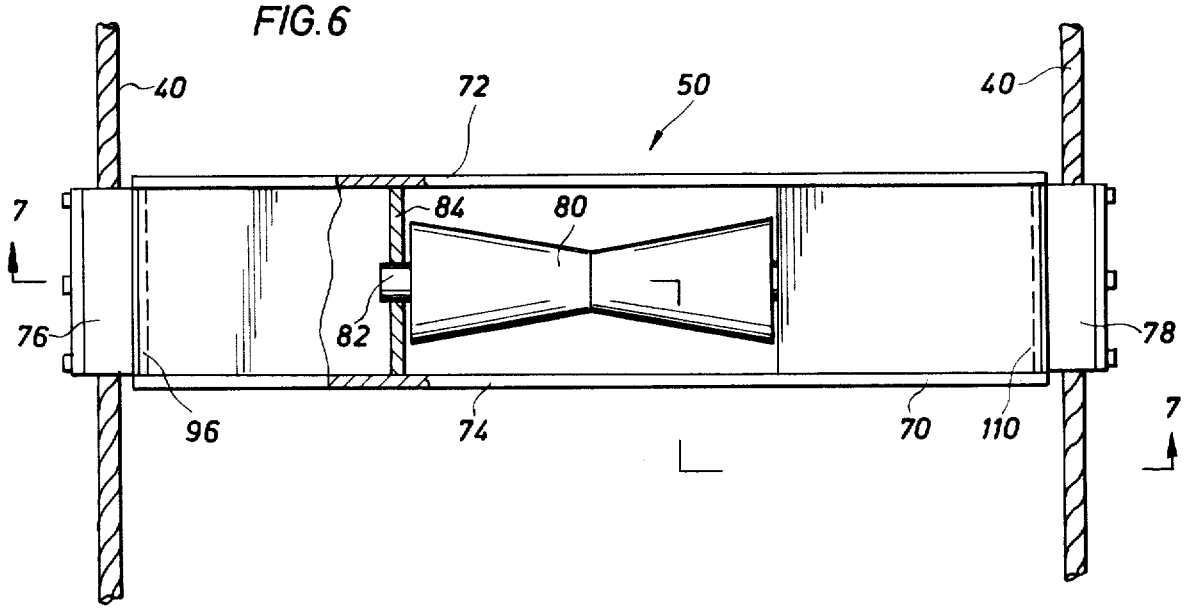
FIGS. 6 - 8 are top, front and side views respectively of one of the support buckets employed in the pipe handling apparatus illustrated in FIGS. 1 - 5.
Figure 8:
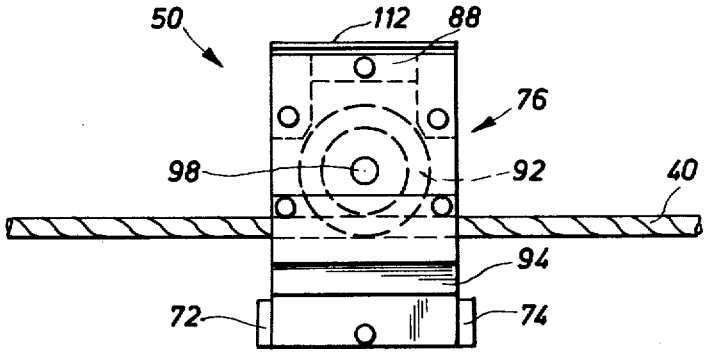

A suitable bucket for use in the series of support buckets 48 for supporting the pipe during its transportation is shown in FIGS. 6, 7 and 8. The bucket illustrated therein is a double sheave bucket having a support sheave mounted on each side for riding on each of the support cables. With particular reference to FIG. 6, bucket 50 includes a frame 70 comprising a first plate 72 and a second plate 74 which extend in a parallel fashion transversely to support cables 40. Attached to the sides of frame 70 is a sheave assembly 76, 78. A roller 80 is disposed centrally of frame 70 and is freely rotatable about axle 82 which is mounted in support plates 84 and 86 (not shown). Roller 80 is formed in the shape of an hourglass to assist in maintaining a section of pipe or other similar elongate member in a central position on support bucket 50.

Additional details of support bucket 50 may be had with reference to FIG. 7. Sheave assembly 76 comprises a pair of pulley plates 88 and 90 which surround a support sheave 92 with a bracket 94 extending between side plate 96 and pulley plate 90 to give support to the sheave assembly. Support sheave 92 is freely rotatable on an axle 98 having a first end carried in side plate 96 and a second end carried in pulley plate 90. Support bucket 50 and sheave assembly 76 are further illustrated in the side view of FIG. 8. In this view, bracket 94 is observed to be of a width equal to that of pulley plate 90 to give uniform support to sheave assembly 76.

Sheave assembly 78 is of a similar construction having pulley plates 100 and 102 surrounding a support sheave 104 that is freely rotatable about an axle 106. A bracket 108 adds support to the sheave assembly and connects between pulley plate 102 and a second end plate (not shown).

Frame 70 has a box-like construction formed by the side plates 96 and 110, the front and rear plates 72 and 74, the top plates 112 and 114, and the support plates 84 and 86. As shown, top plates 112 and 114 of frame 70 are placed in an inclined attitude, sloping toward the center of the bucket. This configuration, along with the configuration of roller 80, together constitute a concaved topside cross-sectional configuration for support bucket 50. This type of configuration, of course, assures that the pipe 36 will not roll to one side or the other, but will instead remain accurately centered on the support bucket.

Figure 9:
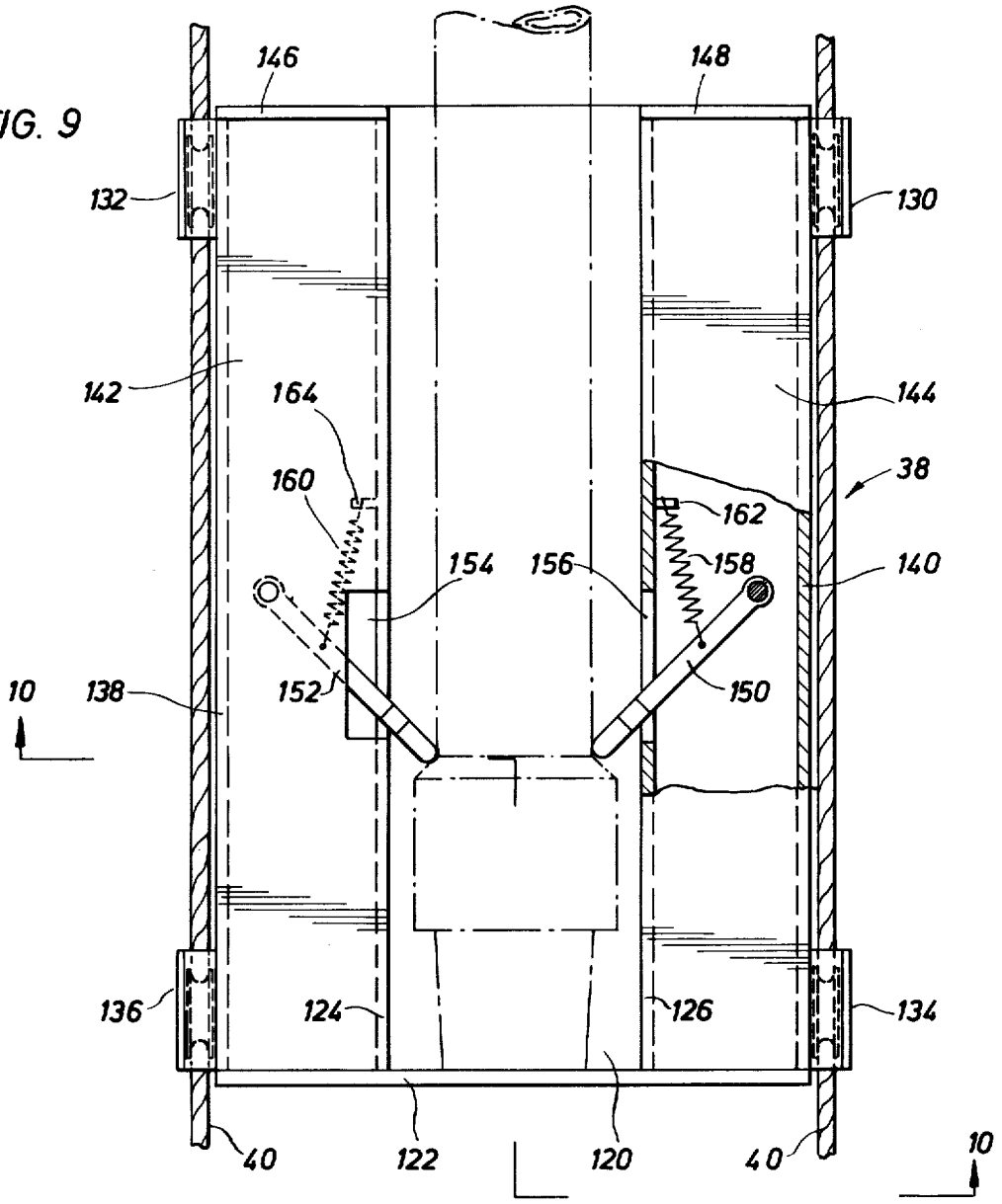

In the plan view of FIG. 9, rear bucket 38 is shown accommodating the lower end of a section of pipe and is illustrated in position on support cables 40. The stand of pipe is accommodated in a channel 120 extending centrally of rear bucket 38 and butts against stop plate 122. Rearward motion of the section of pipe relative to rear bucket 38 is prevented by stop plate 122, thus preventing pipe that is being transported from sliding out. Channel 120 is formed by support plates 124 and 126 which extend along the entire length of rear bucket 38 with the pipe held within channel 120 resting on a floor plate 128 (FIG. 10).

Rear bucket 38 is similar in basic construction to support bucket 50; however, rear bucket 38 is longer and includes front support sheaves 130, 132 and rear support sheaves 134, 136. Rear bucket 38 is of a box-like construction having a frame comprising floor plate 128, side plates 138, 140, top plates 142, 144, stop plate 122 and front plates 146, 148.

Figure 10:
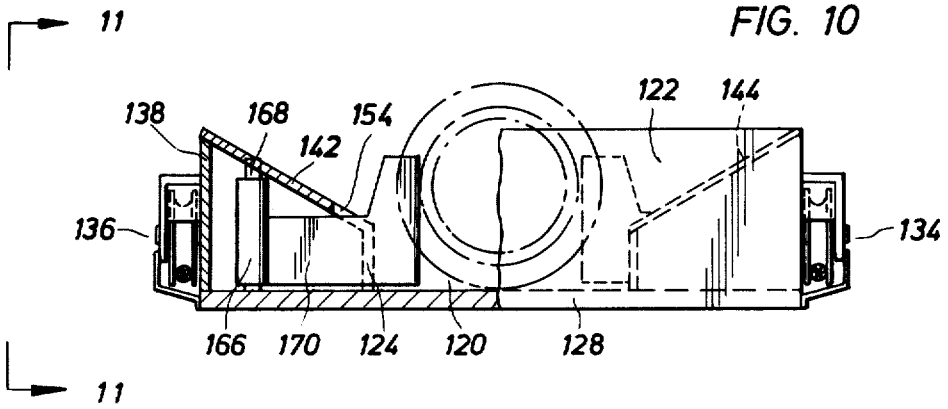

As best illustrated in FIG. 10, top plate 142 extends in an inwardly inclined manner and is attached between support plate 124 and side plate 138. Similarly, top plate 144 connects between side plate 140 and support plate 126 and is also downwardly inclining. Also illustrated in FIG. 10 is stop plate 122, which as viewed from the rear, is observed to extend vertically in height to the top of side plates 138 and 140. Stop plate 122 and its connection to side plates 138, 140 and to floor plate 128 must be sufficiently sturdy to support the heavy weight presented by a near vertically standing section of pipe.

Referring again to FIG. 9, rear bucket 38 is outfitted with a gripper mechanism for maintaining the pipe within the channel 120 and to prevent forward motion of the pipe relative to rear bucket 38. The gripper mechanism comprises first and second spring-loaded lever arms 150, 152 which are pivotally mounted on opposite sides of channel 120. A cut out portion 154 in top plate 142 and side plate 124 is necessary to permit the lever arm 152 to extend from within the bucket frame into the channel 120. A similar cut out 156 is made in top plate 144 and support plate 126 to accommodate lever arm 150. Both lever arm 150 and 152 are spring biased by springs 158 and 160, respectively. A first end of spring 158 connects to a lug 162 attached to support plate 126, and the opposite end of spring 158 connects to lever arm 150 at a point intermediate the ends thereof. Spring 160 connects in a similar manner to a lug 164 attached to support plate 124.

With reference again to FIG. 10, an elevation view of the gripping mechanism of rear bucket 38 is in view with the stop plate 122 being cut-away. Specifically, in this view lever arm 152 is seen to have a collar 166 which receives a pin therethrough to provide lever arm 152 with pivotal movement, permitting various sizes of pipe to be held by the gripping mechanism. Lever arm 152 also has an extended portion 170 that passes through cut out 154 and extends into channel 120. Lever 150 is of a similar construction having a collar and extended portion pivotal around a pin.

Figure 11:
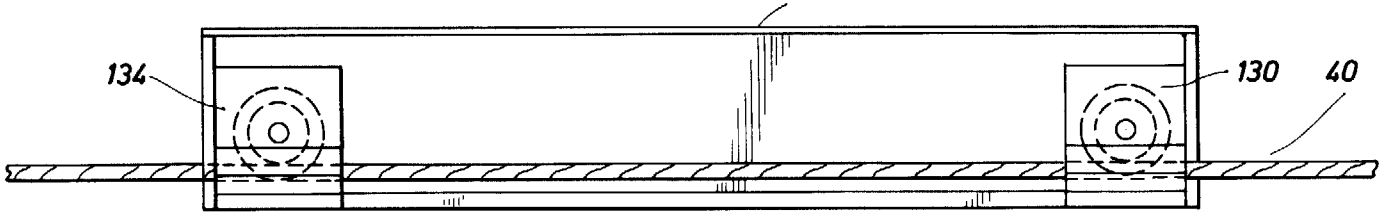
FIGS. 9 - 11 are top, rear and side views of the rear bucket of the apparatus illustrated in FIGS. 1 - 5.

FIG. 11 is a simple side view of rear bucket 38 illustrating the positioning of the bucket with respect to the support cables. The support sheaves 130, 132 and 134, 136 (now shown) are positioned vertically on side plates 138 and 140 to provide rear bucket 38 with a relatively low center of gravity with respect to the support cable 40. The positioning of the support sheaves can also be observed from the view in FIG. 10, wherein the support sheave assemblies 134 and 136 are shown in place on side plates 138 and 140. Also, FIG. 10 illustrates the support sheaves in more detail than does FIG. 11. The construction of the support sheaves 130, 132, 134 and 136 is similar to that of sheave assemblies 76 and 78 of support bucket 50 and will therefore not be discussed in detail.

Figure 12:
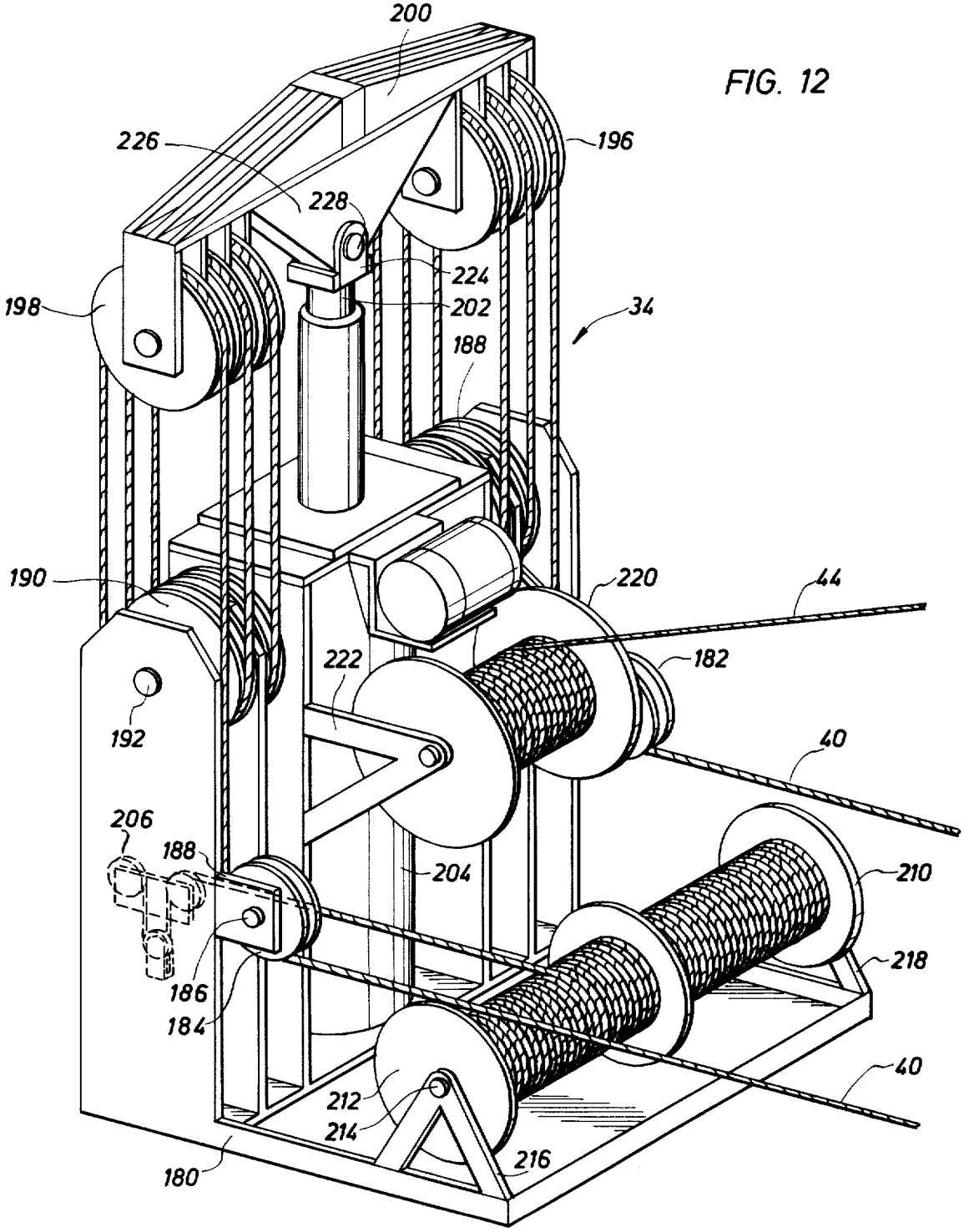
FIG. 12 is a perspective view of a cable draw works assembly which may be used in a pipe handling apparatus in accordance with the present invention.

The draw works assembly 34 is shown in detail in FIG. 12. Draw works assembly 34 is providing with a frame 180 suitable for mounting to a skid which can be disposed adjacent the catwalk 28 in some manner and comprises a series of fixed sheaves and movable sheaves. Support sheave 184 is held in position on a shaft 186 that is carried in a mounting plate 188 and support sheave 182 is similarly disposed on the opposite side of frame 180. Additional fixed sheaves are disposed at 188 and 190 for rotation about shaft 192 and shaft 194 (not shown), respectively, which are likewise supported on the frame 180. Moveable sheaves 196 and 198 are carried by a member 200 that is pivotally attached to a shaft 202 of a hydraulic cylinder 204. The hydraulic cylinder 204 and shaft 202 are adapted to vertically move the movable sheaves 196 and 198. Hydraulic cylinder 204 is disposed at a central position near the rear of frame 180 with fixed sheaves 188 and 190 being disposed on each side.

Support cables 40 enter the draw works assembly over the pair of support sheaves 182 and 184. The support cables 40 then extend upwardly to movable sheaves 196 and 198 and alternately travel around fixed sheaves 188, 190 and movable sheaves 196, 198. The support cables then pass through alignment sheaves 206 and 208 (not shown) which are disposed on the inside of frame 180. The ends of the two support cables 40 come off of the alignment sheaves 206 and 208 and are wound on drums 210 and 212. Drums 210 and 212 rotate around a single axis 214 which is carried by mounts 216 and 218 that are affixed to the front portion of frame 180. Another drum 220 is attached to frame 180 by a mount 222. Drum 220 is the take-up spool for pull cable 44 that attaches to rear bucket 38 and can be driven by a hydraulic or electric power source to operate as a winch.

Slackening or tensioning of support cable 40 is accomplished through the raising or lowering of member 200 by hydraulic cylinder 204 and shaft 202. It will be appreciated that it is important to the operation of the pipe handling system of the invention to maintain the support cables under substantially equal tension during the various pipe handling operations. Equal tensioning of the support cables is accomplished by the pivotal connection of member 200 to shaft 202. Specifically, a clevis 224 is mounted on the end of shaft 202 and receives the apex of a triangular shaped member 226 carried on the other underside of member 200. The triangular shaped member 226 pivots in clevis 224 about a pin 228. Accordingly, as the member 200 is being moved by hydraulic cylinder 204 to tension or slacken the support cables 40, the tension of the support cables will be equalized as the member 200 is able to pivot from side-to-side to compensate for any difference in cable tension existing between the two cables.

Numerous variations and modifications may obviously be made in the apparatus herein described without departing from the present invention. Accordingly, it should be clearly understood that the embodiment of the invention herein described and shown in the FIGURES of the accompanying drawings are illustrative only and are not intended to limit the scope of the invention.

What is claimed is:

1. Apparatus for transporting an elongate member between an elevated area and a lower area comprising, a. dual side-by-side support cables forming an inclined track extending between the elevated area and the lower area, b. a lowermost bucket movable along the track (a) for holding and supporting the lower end of the elongate member, said bucket including,
   i. a frame having a concave topside cross-sectional configuration and a stop plate at the rear for abutting the end of the elongate member, and
   ii. support sheaves mounted on the frame (i) to movably support said frame on the track (a),
c. cable means for controlling the movement of the lowermost bucket (b) along the track (a),
d. a series of a plurality of interconnected buckets movable along the track (a) from an adjacent relationship into a spaced relationship for supporting the remainder of the elongate member as it is being transported between the elevated area and the lower area, each said bucket including,
   i. a frame having a concave topside cross-sectional configuration,
   ii. support sheaves mounted on the frame (i) to movably support said frame on the track (a), and
   iii. a roller disposed centrally of the frame (i) and transverse to the track (a) to permit the elongate member to freely slide over the frame, and
e. drawworks means for slackening the dual cables of the track (a).

2. The apparatus of claim 1 wherein the series of buckets (d) is disposed on the track (a) between the lowermost bucket (b) and the elevated area and anchored to said elevated area.

3. The apparatus of claim 1 wherein the lowermost bucket (b) includes gripping means mounted to the frame (b) (i) for engaging the elongate member to limit the movement of said frame relative to the elongate member.

4. The apparatus of claim 3 wherein the gripping means comprises first and second spring biased arms pivotally mounted to the frame (b) (i) and operable to engage the elongate member near the end.

5. The apparatus of claim 1 wherein the drawworks means (e) includes,
   i. a frame,
   ii. first and second fixed sheaves mounted on said frame (i),
   iii. first and second movable sheaves aligned with said first and second fixed sheaves (ii) for receiving the dual cables, respectively, of the track (a), said cables alternately passing over said fixed sheaves (ii) and said movable sheaves (iii),
   iv. first and second drums for taking in or paying out the dual cables of the track (a),
   v. power drive means for moving said first and second movable sheaves (iii) with respect to said fixed sheaves (ii) to slacken or tension the dual support cables of the track (a), and
   vi. said first and second movable sheaves (iii) being disposed on opposite sides of a pivot point through which said power means (v) acts in moving said movable sheaves to equalize the tension in the dual support cables of the track (a).

* * * * *